US008752303B2

(12) United States Patent
Priebe

(10) Patent No.: US 8,752,303 B2
(45) **Date of Patent: *Jun. 17, 2014**

(54) SIGHTING SYSTEM

(76) Inventor: Donald Priebe, Pinckney, MI (US)

( * ) Notice: Subject to any disclaimer, the term of this patent is extended or adjusted under 35 U.S.C. 154(b) by 230 days.

This patent is subject to a terminal disclaimer.

(21) Appl. No.: 13/350,930

(22) Filed: Jan. 16, 2012

(65) Prior Publication Data

US 2012/0180329 A1 Jul. 19, 2012

Related U.S. Application Data

(63) Continuation-in-part of application No. 12/718,487, filed on Mar. 5, 2010, now Pat. No. 8,099,874.

(51) Int. Cl.
*F41G 1/467* (2006.01)

(52) U.S. Cl.
USPC ..... 33/265; 124/87

(58) Field of Classification Search
USPC ..... 33/265; 124/87
See application file for complete search history.

(56) References Cited

U.S. PATENT DOCUMENTS

| | | | | |
|---|---|---|---|---|
| 2,534,946 | A | 12/1950 | Bradley | 356/253 |
| 4,542,591 | A | 9/1985 | Montgomery | 33/265 |
| 4,833,786 | A | 5/1989 | Shores, Sr. | 33/265 |
| 4,977,677 | A | 12/1990 | Troescher, Jr. | 33/265 |
| 5,121,547 | A | 6/1992 | Littlejohn | 33/265 |
| 5,339,227 | A | 8/1994 | Jones | 362/109 |
| 5,524,351 | A | 6/1996 | Pinson et al. | 33/265 |
| 5,634,278 | A | 6/1997 | London | 42/132 |
| 5,671,724 | A | 9/1997 | Priebe | 124/87 |
| 5,791,060 | A | 8/1998 | Godsey | 33/265 |
| 5,850,700 | A | 12/1998 | Capson et al. | 33/265 |
| 5,956,854 | A | 9/1999 | Lorocco | |
| 6,058,921 | A | 5/2000 | Lawrence et al. | 124/87 |
| 6,122,833 | A | 9/2000 | Lorocco | |
| 6,216,352 | B1 | 4/2001 | Lorocco | |
| 6,360,472 | B1 | 3/2002 | Lorocco | |
| 6,385,855 | B1 | 5/2002 | Tymianski | |
| 6,571,482 | B1 | 6/2003 | Tymianski | |
| 6,581,317 | B1 | 6/2003 | Slates | |
| 6,601,308 | B2 | 8/2003 | Khoshnood | |
| 6,651,350 | B1 | 11/2003 | Manns et al. | |
| 6,725,854 | B1 | 4/2004 | Afshari | |
| 6,981,329 | B1 | 1/2006 | Strathman | |
| 7,089,698 | B2 | 8/2006 | Afshari | |
| 7,100,292 | B2 | 9/2006 | Afshari | |
| 7,159,325 | B2 | 1/2007 | Rager | |
| 7,461,460 | B2 * | 12/2008 | Priebe | 33/265 |
| 7,926,190 | B1 * | 4/2011 | Hoffman | 33/265 |
| 8,099,874 | B2 * | 1/2012 | Priebe | 33/265 |
| 2003/0097760 | A1 | 5/2003 | Slates | |
| 2004/0244211 | A1 | 12/2004 | Afshari | |
| 2005/0138824 | A1 | 6/2005 | Afshari | |
| 2006/0156561 | A1 | 7/2006 | Afshari | |
| 2007/0028467 | A1 | 2/2007 | Bradley | 33/265 |

* cited by examiner

*Primary Examiner* — Christopher Fulton
(74) *Attorney, Agent, or Firm* — Brinks Gilson & Lione

(57) ABSTRACT

A sighting system, having front and rear sights, for a shooting device, such as an archery bow, cross bow or a firearm. The front sight includes at least one sighting element. The rear sight includes a rear sight frame that has a lens located therein. At least one sighting aperture is defined on the lens such that the aperture may be aligned with the sighting element of the front sight during aiming of the shooting device.

18 Claims, 4 Drawing Sheets

SIGHTING SYSTEM

CROSS REFERENCE TO RELATED APPLICATION

This application is a continuation-in-part of U.S. application Ser. No. 12/718,487, filed Mar. 5, 2010 now U.S. Pat. No. 8,099,874, the entire contents of which are herein incorporated by reference.

BACKGROUND

1. Field of the Invention

The present invention relates to a sighting system for weapons such as archery bows, cross bows and firearms, used in hunting and/or target shooting.

2. Description of Related Technology

It has long been recognized that weapons, such as archery bows, cross bows and firearms, are difficult to shoot with consistent accuracy without the aid of a sighting system. Many factors can contribute to the inaccuracy of a shot. Such factors include, without limitation, the distance to the target, the size of the target, the speed of the projectile, the weight of the projectile, the wind and visibility conditions, as well as how the shooter holds the weapon itself. Since the distance to the target and the projectile speed both effect the amount of drop the projectile will experience, some consider the attitude, or vertical orientation, of the weapon to be the most significant factor influencing accuracy.

In comparison to other projectiles, an arrow projected from a bow exhibits a relatively low speed, approximately 175 to 350 feet per second. While compound bows and overdraw systems have increased the speed of the arrow, and therefore lessened the amount of vertical drop, the effect of gravity still must be taken into account regardless of the length of the shot. This is typically done by changing the attitude of the bow and "holding above" the target when aiming.

While instinct shooters rely on experience and familiarity with their equipment to compensate for accuracy influencing factors, most archers prefer to use a bow sight. The typical bow sight is mounted to the riser of the bow so as to locate one or more sight pins forward of the riser, with the ends of the pins located on the same side of the riser as the arrow rest. Thus, the sight pins are generally positioned above the rest. The sight pins are vertically spaced from one another and are individually set by the archer, through trial and error, so that each pin corresponds with a predetermined shooting distance to the target. For example, one sight pin may be set for a fifteen-yard shot, a second for a twenty-five yard shot, and a third pin for a thirty-five yard shot. When set in this manner, the sight pin corresponding with the distance to the target is then aligned with the target during the actual shot.

One drawback of the above-mentioned type of sight is that the pins only provide a single sighting point for the aiming of the bow. Such a system requires that the bow be consistently held in the same position, relative to the archer, for the sight to be accurate. If the bow is held slightly higher, lower, leftward or rightward relative to the archer, then inaccuracy will be introduced into the sighting process.

As a result, a variety of secondary sights have been developed. Secondary sights, as the term is used herein, provide the archer with a secondary aiming reference. This secondary aiming reference is used in conjunction with the previously mentioned front sight and, therefore, facilitates the bow being more consistently held in the same position relative to the shooter.

In archery, perhaps the most common secondary sight is a peep sight mounted to the bow string. During use, once the bow string is brought to full draw, the archer looks through the peep sight and then aligns the appropriate sight pin on the target. By forcing the archer to look through the peep sight, the bow is held at a more consistent position relative to the archer. While a peep sight system may be considered better than a mere front sight, these systems also have their disadvantages and drawbacks. One significant drawback is that the small aperture of the peep sight significantly limits the amount of light available for viewing the sight pin and the target. This diminished visibility is compounded by the fact that the best hunting times often occur during the marginal light conditions of dawn and dusk.

Another type of secondary sight is a rear sight that is intended to be used in combination with the front sight. One such rear sight is disclosed in the present inventor's own U.S. Pat. Nos. 5,671,724 and 7,461,460, which are herein incorporated by reference. These patents discloses a rear sight ring that is located rearward of the riser, between the riser and the bow string itself, and used in combination with a front sight. In aligning a bow equipped with such a sight, the sighting elements of the rear sight are always centered on the same pin of the front sight, for example the twenty-five yard pin. This properly orients the bow. While maintaining this alignment between the rear sighting elements and the designated front pin, the appropriate distance pin is then located on the target.

Torque or horizontal orientation is also a significant, but often overlooked, factor influencing accuracy in shooting a weapon. If the weapon is not consistently held in the same horizontal orientation, the projectile will be directed left or right of the target. With an archery bow for example, the riser and bow string are independent elements from one another. It is therefore possible to hold the riser and the bow string differently, relative to one another, during subsequent shots. Specifically, when the riser is held in the archer's hand, if the riser is rotated about a vertical axis extending through the archer's hand (i.e. upward through the grip of the riser), then a sight located in the front of the riser will move in one direction, while a fixed point to the rear of the riser will rotate in the opposite direction. Thus, at full draw, the bow string can be held in a consistent position relative to the archer, but the riser may be rotated via the archer's hand about a vertical axis. When held in this manner, it is still possible to align the front sight in the presence of this torque, but the arrow will be projected off-line from the target, toward the left or the right, depending on which directed the riser is rotated.

Even with the advent of the sights described in the above mentioned patents, there still remains a degree of view obstruction, by the rear sight, of the target. As with the peep sight, this obstruction is compounded by the locating of the rear sight closer to the eye of the shooter.

In view of the above limitations and drawbacks, it is seen that there exists a need for an improved sight that can be used to more accurately aim a weapon at the target, without overly complicating the shooting process, and without compromising the vision of the shooter during lowlight situations.

SUMMARY OF THE INVENTION

In satisfying the above need, as well as overcoming the enumerated drawbacks and other limitations of the related art, the present invention provides a sighting system for a weapon that includes dual sights, a front sight and a rear sight.

The front and rear sights are supported on a mount so that it may configured to be mounted to an archery bow, a firearm, or other weapon. While the front sight is supported toward a distal end of the mount, the rear sight is supported toward the opposing or proximal end of the mount.

The front sight may be one of a variety of front sights. For example, the front sight may include a front sight frame or ring that defines a front sighting area. Within the front sighting area, at least one sighting element such as a sight pin extends generally from the front sight ring toward a center area of the front sighting area.

The rear sight includes a rear sight ring or frame, which encapsulates a lens therein. The lens includes at least one indicia defining a sighting aperture generally at a central area of the lens. When a shooter utilizes the sighting system of the present invention, the sight pin of the front sight is viewable through the lens. Thus, the shooter aims the sighting system by aligning the sight pin with the sighting aperture.

Further aspect, objects, features and advantages of this invention will become readily apparent to persons skilled in the art after a review of the following description, with reference to the drawings and claims that are appended to and form a part of this specification.

BRIEF DESCRIPTION OF THE DRAWINGS

The drawings described herein are for illustration purposes only and are not intended to limit the scope of the present disclosure in any way.

DETAILED DESCRIPTION

Figure 1:
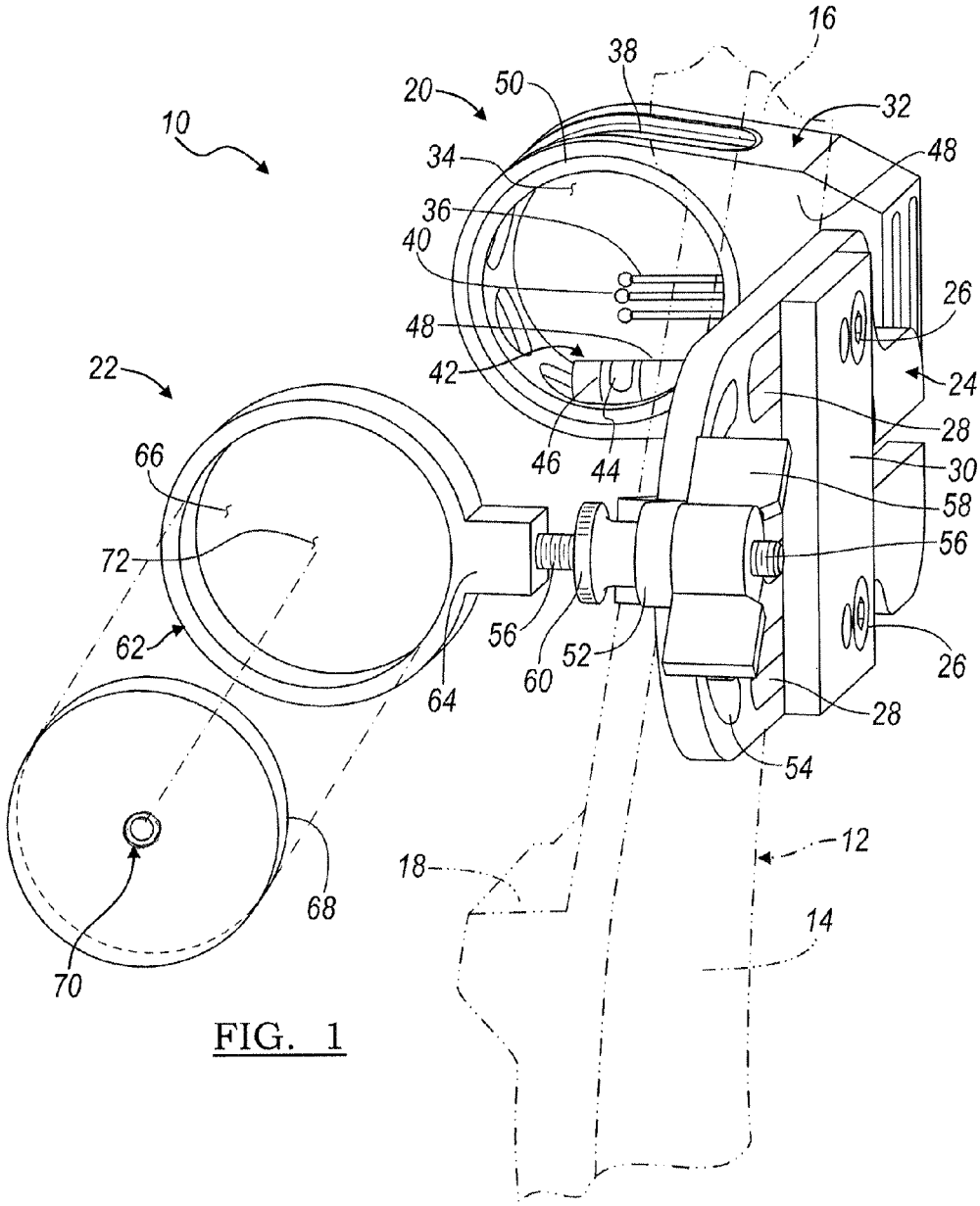
FIG. 1 is a rear perspective view of a sighting system, embodying the principles of the present invention, mounted to the riser of an archery bow.

Referring now to the drawings, it is to be understood that throughout the drawings, corresponding reference numerals are used to indicate like or corresponding elements, parts and features. Accordingly, elements depicted in various figures are interchangeable with similar elements in other figures, unless stated to the contrary.

A sighting system, embodying the principles of the present invention, is illustrated in FIG. 1 and generally designated at 10. While the sighting system 10 is illustrated as being mounted to the riser of an archery bow, it will be appreciated that the present invention is intended for use with other weapons or devices that require aiming. Such other weapons include, without limitation, cross bows, rifles, pistols, other firearms, air rifles, paint ball guns. However, and for the sake of clarity and brevity, the following description will be limited to describing the sighting system 10 in connection with an archery bow. Unless specifically defined as such therein, the appended claims are not intended to be restricted to any particular type of weapon.

A typical bow 12 includes a riser 14 from which extend a pair of limbs 16. If the bow 12 is a compound bow, one or both of the limbs 16 includes a wheel, cam or pulley mounted at its end. A bow string (not shown), extends between the limbs 16 and around the wheel(s) and is often provided with nocks that allow for an arrow (not shown) to be squarely located on the bow string relative to an arrow rest 18 that is attached to or formed with the riser 14.

It is noted that the rearward and forward directions referred to in the following description are for reference purposes only and are to be determined relative to the shooting direction of the particular weapon to which the sighting system 10 is utilized. For example, in an archery bow application, the forward direction is the direction in which an arrow would be projected from the bow. The rearward direction would accordingly be toward the shooter.

The illustrated bow 12 of the figures is also a right-handed bow. Obviously, the present invention could be utilized in a left-handed configuration. In such a configuration, left- and right-hand designations in the description would merely be reversed.

When configured for mounting to an archery bow 14, a sighting system 10 embodying the principles of the present invention will typically be mounted to the riser 14 on a side opposite of the arrow rest 18. The sighting system 10 principally includes a front sight 20, a rear sight 22, and a mount 24 located therebetween. The mount 24, which may be in the form of a common mounting plate, may be secured to the riser 14 by bolts, screws or other fasteners 26. To provide adjustability in the mounting of the sighting system 10, the mount 24 may be provided with one or more slots 28. The slots 28 thus enable the mount 24 to be variably positioned forward, rearward, upward, and downward relative to the riser 14. A clamp bar 30 may be used in conjunction with the fasteners 26 so as to clamp the mount 24 between the clamping bar 30 and the riser 14.

As will become apparent from the following discussion, the front and rear sights 20, 22 may be formed as separate structures that are individually mounted and adjusted relative to the riser 14, each with its own mount 24. The mount 24 can be provided with additional features that will enable other shooting accessories to be mounted to it.

The front sight 20 is attached to a forward or distal end of the mount 24 such that the front sight 20 is located in a position forward of the riser 14. Generally, the front sight 20 mounts at an angle that is approximately 90° relative to the plane of the mount 24. As would be typical for a right handed bow 12, the front sight 20 extends from the mount 24 to the left. By being offset from the mount 24 in this manner, the front sight 20 is located to left of the riser 14, above the arrow rest 18. The front sight 20 may be attached to the mounting bracket 24 in a variety of ways, including without limitation, a threaded shaft and nut combination. Additionally, the front sight 20 may be axially adjustable and/or vertically adjustable relative to the mount 24. Since the various means for adjustable attaching a front sight to a mount 24 are either well known in the industry or readily engineered, the specific details of such a mounting structure need not be discussed herein and are omitted in the interest of brevity.

The front sight 20 includes a front sight frame or ring 32. Generally centrally defined in the front ring 32 is an opening or aperture 34, which is hereinafter referred to as the sight window 34. The front sight ring 32 may be formed of various materials and manufactured by various methods. Such materials include, without limitation, metals and plastics and such manufacturing methods include, without limitation, machining, stamping, and molding.

Multiple sight pins 36, three in the illustrated embodiment, extend from the ring 32 inwardly into the sight window 34. The sight pins 36 are mounted to the ring 32 as is well known in the industry, which may be an adjustable (preferred) or a fixed mounting. The sight pins 36 themselves may be formed from a variety of materials. One current practice is to construct the sight pins 36 from strands 38 of fiber optic material. In one possible construction, the strands 38 extend, in an exposed manner, about the periphery of the ring 32 before terminating in the sight pins 36 located within the sight window 34. By providing the strands 38 about the exterior of the frame 32 in an exposed manner, it allows the strands 38 to collect light and illuminate the tips 40 of the sight pins 36 within the sight window 34. Additional aspects and details of sight pins 36 as utilized in the art are well known and, therefore, need not be further described herein.

The front sight 20 may also be provided with a level 42, which is shown as being mounted to the sight ring 32 in a lowermost portion of the sight window 34. The level 42 is a common bubble-type level that includes an air bubble 44 retained within a liquid filled glass tube 48. When the level 42 is held in a horizontal position, the bubble 44 comes to rest between two spaced apart indicia or lines 46 provided on the glass tube 48. By using the level 42, the shooter can determine if the sighting system 10 is tilted out of horizontal, to either the left or the right.

The rear sight 22 is mounted to the rearward or proximal end of the mount 24. The rear sight 22 may be mounted in a fixed position (as illustrated) via a single mounting boss 52. Alternatively, the rear sight 22 may be adjustably mounted in an arcuate or straight (horizontal or vertical) slot 54 provided in the rearward end of the mount 24. While various means can be used to mount the rear sight ring 22, one such means is illustrated and includes a threaded shaft 56 extended through the mounting boss 52 and engaged by a wing nut 58. A locking nut 60 may be provided on the threaded shaft 56 such that the mounting boss 52 is clamped between the locking nut 60 and the wing nut 58. As one skilled in the art will appreciate, other mounting mechanisms could readily be used.

Relative to an archery bow 12, the rear sight 22 is positioned in a location between the riser 14 and the relaxed position of the bow string. Like the front sight 20, the rear sight 22 is positioned laterally away from the mount 24 and towards the same side of the riser 14 as the front sight 20. In the right-handed bow 12 of the figures, the rear sight 22 is located to the left of the riser 14, generally above the arrow rest 18.

The rear sight 22 includes a rear sight ring 62 attached to the inboard end of the threaded shaft 56. The ring 62 may be mounted by various means to the shaft 56 including being threadably engaged with the shaft, adhesively retained with the shaft, integrally molded onto the shaft or unitarily formed with the shaft. As shown, the ring 62 is unitarily formed with a boss 64 within which the shaft 56 is received.

Adjacent to the boss 64, the ring 62 is preferably provided with an annular shape, within which an opening or rear sight window 66 is defined. The rear sight window 66 is occupied by a lens 68, which may be permanently or interchangeably retained within the ring 62 according to a variety of techniques. Accordingly, the lens 68 may be adhesively secured to the ring 62, insert molded to the ring 62, unitarily formed with the lens 62, snap fit to the ring 62, mechanically retained with the ring 62, etc. As those of skill in the art will appreciate, the lens 68 additionally may be clear or tinted, and may be formed from one of a variety of materials, such as glass and/or various plastics, such as polycarbonate or acrylic. According to another implementation, the lens 68 the lens may be of a planar shape, a plano-convex shape, a double-convex shape or a concavo-convex shape.

Defined in the center of the lens 68, and also preferably in the center of the sight window 66, is a sighting aperture 70. The sighting aperture 70 may be formed in a variety of configurations. For instance and as seen in FIGS. 4A-D, the sighting aperture 70 may be formed as an opening through the lens 68 in the shape of a straight bore, a conical bore, a countersink, a counterbore, etc. In those embodiments other than the straight bore, the side walls of the sighting aperture 70, or portions thereof, will be visible to the archer, thus defining indicia, and more readily allow the archer to locate the sighting aperture 70 during the process of aiming and shooting. If desired, the sidewalls of the sighting aperture 70 may be coated or colored to enhance their visibility to the archer. Further, the lens 68 may be configured to provide for the magnification of objects viewed through the lens 68.

Figure 2A:
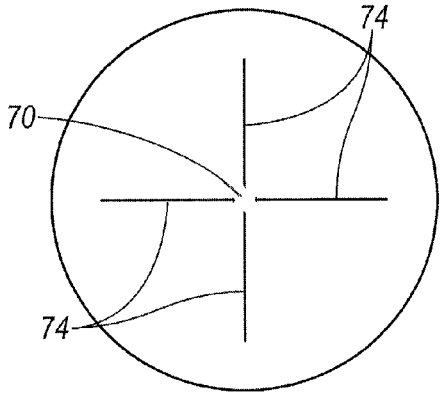
FIGS. 2A-2C illustrate alternative embodiments of the rear sight used in the sighting system of FIG. 1.
Figure 2B:
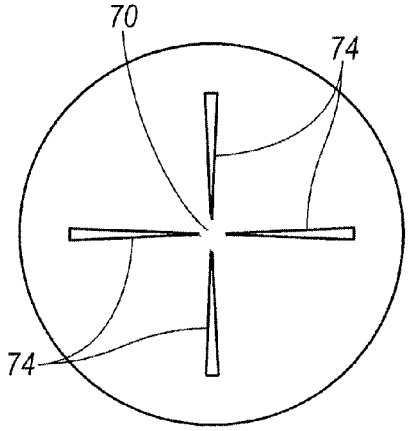
Figure 2C:
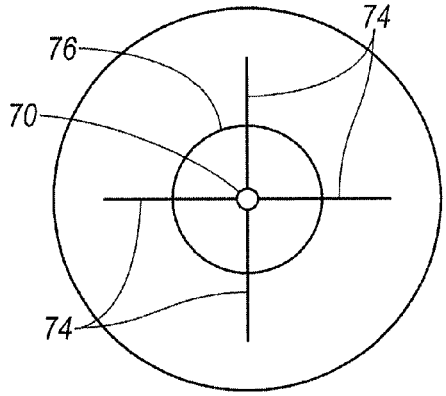

In an additional embodiment, the sighting aperture 70 of the lens 68 may include portions that define the location of the sighting aperture 70, either as a discrete element or a central area. These portions may include a variety of indicia on, in or through the lens so as to draw an archer's attention to the sighting aperture 70 defined thereby. The indicia may be provided in a variety of different forms and may be referred to by a variety of nomenclature. As shown in FIGS. 2A-2C, for example, the indicia may be in the form of radial lines 74 that extend generally toward center of the lens 68 so as to define the sighting aperture 70 in the center of the lens 68. While the lines 74 are shown as extending vertically and horizontally toward the sighting aperture 70, it will be appreciated that the lines 74 may alternatively extend diagonally. The lines 74 may be straight as in FIG. 2A or tapered toward the sighting aperture as in FIG. 2B. In either implementation, the lens 68 may also include a circular line 76 disposed between the sighting aperture 70 and the sight ring 62, as shown in FIG. 2C. Preferably, if so provided, the circular line 76 is generally concentric with the sighting aperture 70, which also may be specifically delineated with a circular line, to further assist an archer in aligning the sighting aperture 70 with the sight pins 36. The indicia or lines 74, 76 may be etched or engraved into the lens 68, or alternatively, the lines 74, 76 may provided as decals or appliqués applied to the surface of the lens 68 or may be provided within the lens 68 itself.

Figure 5:
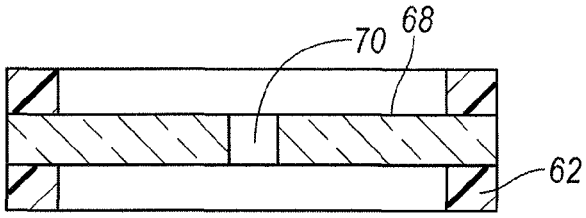
FIG. 5 is a cross sectional view through alternative embodiments of the rear sight of the sighting system seen in FIG. 1.

In any of the above embodiments, various means may be employed to increase visibility of the sighting aperture 70 and/or lines 74 and 76. By way of example, the side walls of the sighting aperture 70 and the lines 74, 76 may colored or tinted with a transparent, opaque or luminescent paint or material. Furthermore, one or more light sources, battery or photo-voltaic operated, may be provided so as to introduce light into an edge of the lens 68 thereby lighting the sidewalls of the through aperture or any indicia or lines 74, 76 on the surface of or in the lens 68. Alternatively, the circumferential edge of the lens 68 may be exposed through the sight ring 62 so as to allow natural light to enter into the lens 68 by way of the edge and thereby illuminate the sidewalls of the sighting aperture 70 (as seen in FIG. 5) or the otherwise provided indicia or lines 74, 76 (seen in FIGS. 2A-2C). Obviously, any suitable means for providing illumination may alternatively be employed, and all of the above are herein termed as being luminous.

When using an archery bow 12 with a properly set up and sighted-in sighting system 10 of the present invention, the archer raises the bow 12 and brings the bow string to full draw. In aiming such an equipped bow 12, a predetermined one of the sight pins 36, such as the middle distance sight, is positions so that the distal end or tip 40 of the sight pin 36 is located and centered within the sighting aperture 70. While maintaining the tip 40 of the predetermined sight pin 36 within the sighting aperture 70, the distance to the target is determined and the tip 40 of the appropriate distance sight pin 36, which may be the same as the predetermined sight pin 36 mentioned above, is located on the target. In doing this, if equipped with a level 42, the bubble 44 of the level 42 should be maintained between the level lines 46 to ensure that the bow 12 is not tilted toward the left or toward the right. The shot is then taken.

Since both the front and rear sights 20, 22 are mounted in fixed positions (forward and aft) relative to the riser 14, and are therefore not independent of the riser 14 during the aiming process, the present system 10 also enables a quick determination by the shooter as to whether or not torque (rotation of the bow 12 about a vertical axis) has been introduced into the aiming process.

Figure 3:
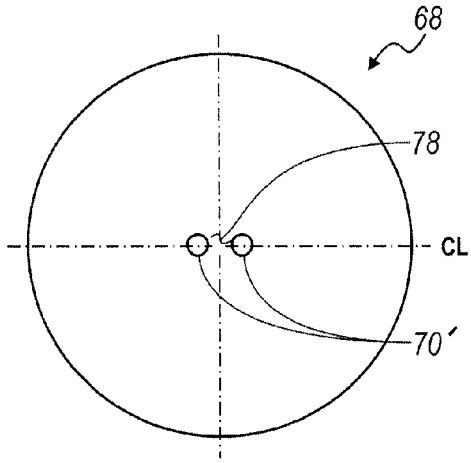
FIG. 3 is an alternative embodiment of the rear sight used in the sighting system of FIG. 1.
Figure 3A:
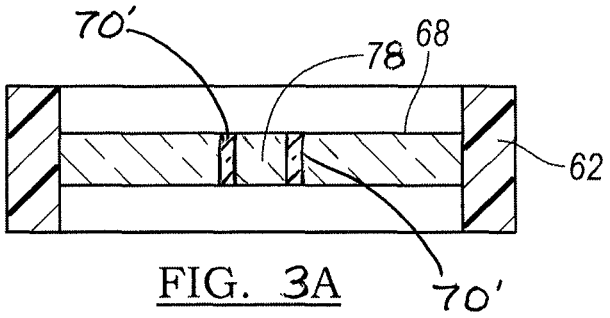
FIGS. 3A and 3B are alternative cross sectional views through a rear sight similar to that depicted in FIG. 3.
Figure 3B:
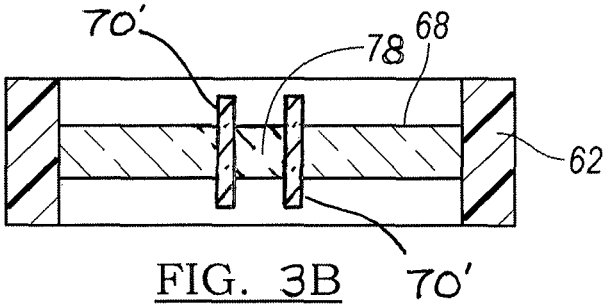
Figure 4A:
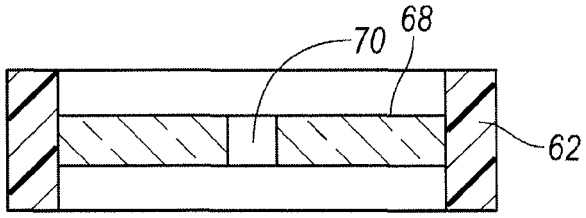
FIGS. 4A-D are cross sectional views through alternative embodiments of the rear sight of the sighting system seen in FIG. 1.
Figure 4B:
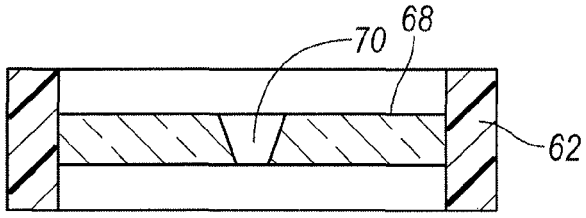
Figure 4C:
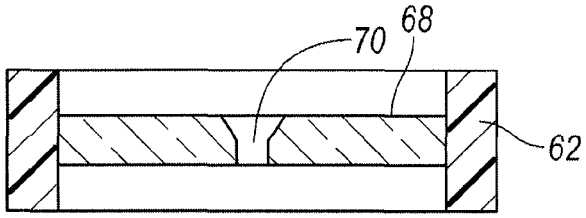
Figure 4D:
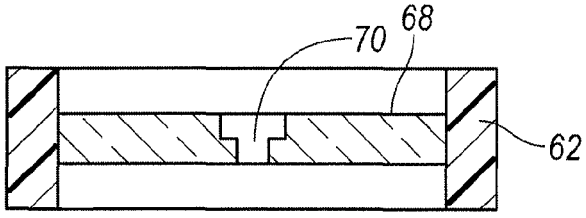

Referring now to FIGS. 3, 3A and 3B, an alternative lens 68 for the system of FIG. 1 is shown therein. In this embodiment, the lens 68 includes two indicia 70' located along a center line $C_L$ defining a horizontal axis. Each indicium 70' is preferably spaced apart an equal distance from the center of the lens 68 so as to define and form a central area 78 there between. When aiming the sighting system 10, the predetermined sight pin 36 of the front sight 20 may be viewed through the lens 68 and aligned within this central area 78, between the two indicia 70'.

The indicia 70' may be provided in various forms, including openings extending through the lens, etchings, engravings or applique's on the lens. In one preferred embodiment, seen in FIGS. 3A and 3B, the indicia 70' are provided as fiber optic elements that extend generally along the line of sight through the lens 68. As such, the fiber optic elements may be located within bores formed in the lens 68 or molded into the lens 68. If the lens 68 is edge illuminated, the indicia 70' will collect the light and be illuminated, with this illumination being visible through the ends of the indicia 70' as in FIG. 3. Additionally, one or both ends of the fiber optic elements may be flush with or may protrude beyond the surface of the lens 68, thereby enhancing the light collecting capabilities of the fiber optic elements. As will be readily appreciated, the lens 68 with the indicia 70' may include all or some of the alternative features, elements and indicia discussed above in connection with the other alternative embodiments.

As will be understood by those of skill in the art, the present invention as described above provides a sighting system 10 that enables an archer to view a target in a substantially unobstructed manner. The present invention does, however, have application to non-archery systems and the rear sight, as generally described, could be used in connection with a different style and type of front sight. For example, when utilized in a rifle application, the rear sight could be used in conjunction with a bead sight that typically is a part of the iron sights of a rifle, a bead-type sight that employs a length of fiber optic (light gathering) material, the end of which is viewed in a similarly fashion to a bead, or an illuminated bead-type of sight (one such system being disclosed in U.S. Pat. No. 5,956,854, which is hereby incorporated by reference in its entirety). Additionally, the rear sight could be employed in conjunction with a rifle scope, with the rear sight being located rearward of the scope's rear reticule, toward the shooter. Such a rifle scope may employ the more traditional cross hairs for aiming or may employ the presentation or projection of a dot (as is done in what are known as "red dot" of aiming systems, one such system being disclosed in U.S. Pat. No. 5,272,514, which is hereby incorporated by reference in its entirety) into the shooter's line of sight for aiming purposes.

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

I claim:

1. A sighting system for aiming a shooting device having a forward end and a rearward end, the system comprising:

a first sight configured to be mounted to a portion of the shooting device and located toward the forward end thereof, the first sight including at least one sighting element; and a second sight configured to be mounted to the portion of the shooting device which the first sight is mounted to and being generally located toward the rearward end thereof, the second sight including a sight frame defining a sight window therein, a lens supported by the sight frame and positioned within the sight window, the lens including portions defining a sighting aperture alignable with the at least one sighting element of the first sight.

2. The sighting system of claim 1 wherein the portions defining the sighting aperture is defined by at least one indicium provided as part of the lens.

3. The sighting system of claim 2, wherein the at least one indicium is selected from a group of indicia consisting of: etchings, engravings, decals and fiber optic elements.

4. The sighting system of claim 2, wherein the at least one indicium is luminous.

5. The sighting system of claim 1, wherein the sighting aperture is concentric with the lens.

6. The sighting system of claim 1, wherein the sighting aperture is a central area defined between a first indicia and a second indicia provided as part of the lens, the first indicia and the second indicia being spaced apart from a central vertical axis of the lens to form the central area therebetween.

7. The sighting system of claim 6, wherein the first indicium and the second indicium are provided along a central horizontal axis of the lens.

8. The sighting system of claim 6, wherein the first indicia and the second indicia are formed of fiber optic elements located within the lens.

9. The sighting system of claim 8, wherein the fiber optic elements extend in a direction along a line of sight through the lens.

10. The sighting system of claim 9, wherein the fiber optic elements are luminous.

11. The sighting system of claim 9, wherein the fiber optic elements are disposed within bores formed in the lens.

12. The sighting system of claim 9, wherein at least one end of the fiber optic elements protrude beyond at least one surface of the lens.

13. The sighting system of claim 6, wherein the lens is a magnification lens.

14. The sighting system of claim 1, wherein the first sight includes a first frame having portions defining a first sight window therein, the at least one sighting element extending generally from the first sight frame toward a center area of the first sight window.

15. The sighting system of claim 1, wherein the at least one sighting element is viewable through the lens during aiming of the shooting device.

16. The sighting system of claim 15 wherein the at least one first sighting element is a fiber optic sight pin.

17. The sighting system of claim 1, wherein the lens is a magnification lens.

18. The sighting system of claim 1, wherein the sighting element of the first sight is one of a bead sight and a fiber optic sight pin.

* * * * *